US008992186B2

(12) United States Patent
Silveira et al.

(10) Patent No.: US 8,992,186 B2
(45) Date of Patent: Mar. 31, 2015

(54) SUCTION ARRANGEMENT FOR A REFRIGERATION COMPRESSOR

(75) Inventors: Marcio Silveira, Joinville-SC (BR); Moacir Pirovano, Joinville-SC (BR); Cleber Knies, Joinville-SC (BR); Ernest Bergman, Yorkshire, OH (US)

(73) Assignees: Emerson Climate Technologies, Inc., Sidney, OH (US); Whirlpool S.A., São Paulo-Sp (BR)

( * ) Notice: Subject to any disclaimer, the term of this patent is extended or adjusted under 35 U.S.C. 154(b) by 0 days.

(21) Appl. No.: 13/699,207

(22) PCT Filed: May 24, 2010

(86) PCT No.: PCT/BR2010/000179

§ 371 (c)(1), (2), (4) Date: Jun. 7, 2013

(87) PCT Pub. No.: WO2011/147005

PCT Pub. Date: Dec. 1, 2011

(65) Prior Publication Data

US 2013/0330177 A1 Dec. 12, 2013

(51) Int. Cl.

| | |
|---|---|
| ***F04B 39/00*** | (2006.01) |
| ***F04B 53/00*** | (2006.01) |
| ***F01D 25/24*** | (2006.01) |
| ***F25B 31/02*** | (2006.01) |

(52) U.S. Cl.

CPC ..... *F01D 25/24* (2013.01); *F04B 39/0061* (2013.01); *F25B 31/023* (2013.01); *F25B 2500/28* (2013.01); *Y10S 417/902* (2013.01); *Y10S 181/403* (2013.01)

USPC ..... 417/312; 417/902; 181/403

(58) Field of Classification Search

CPC ..... F04B 39/0027; F04B 39/0055; F04B 39/0061; F04B 39/0072; Y10S 181/403; Y10S 417/902

USPC ..... 417/312, 902; 181/403

See application file for complete search history.

(56) References Cited

U.S. PATENT DOCUMENTS

| | | | | |
|---|---|---|---|---|
| 3,075,686 | A * | 1/1963 | Steinhagen | 417/363 |
| 4,401,418 | A * | 8/1983 | Fritchman | 417/312 |
| 5,055,010 | A | 10/1991 | Logan | |
| 5,344,289 | A * | 9/1994 | Fasce | 417/312 |
| 7,686,592 | B2 * | 3/2010 | Inoue et al. | 417/312 |
| 2002/0090305 | A1 | 7/2002 | Myung et al. | |
| 2004/0057849 | A1 | 3/2004 | Skinner et al. | |
| 2005/0129534 | A1 * | 6/2005 | Lee | 417/312 |

OTHER PUBLICATIONS

International Search Report and Written Opinion dated Aug. 10, 2010. International Application No. PCT/BR10/00179.

* cited by examiner

*Primary Examiner* — Peter J Bertheaud

(74) *Attorney, Agent, or Firm* — Gifford, Krass, Sprinkle, Anderson & Citkowski, P.C.

(57) ABSTRACT

A refrigeration compressor is provided and may include a shell carrying a suction-inlet tube having an outlet nozzle opened to the interior of the shell and a cylinder block to which is mounted a suction muffler that incorporates an admission tube provided with an inlet nozzle.

The inlet nozzle of the admission tube may be disposed adjacent to the outlet nozzle of the suction-inlet tube. The inlet nozzle may admit under at least one of the conditions of underpressure in its interior or deflection of the refrigerant-fluid flow in the interior of the shell the gaseous phase and may direct the liquid phase to a region of the shell external to the inlet nozzle.

2 Claims, 6 Drawing Sheets

SUCTION ARRANGEMENT FOR A REFRIGERATION COMPRESSOR

FIELD

The present disclosure refers to a constructive arrangement to be applied to the suction of hermetic refrigeration compressors in general. The arrangement is particularly directed to the suction of hermetic compressors used in refrigeration systems for commercial use, such as, for example, ice cube-making machines.

BACKGROUND

Hermetic refrigeration compressors (of small or medium size), such as those generally used in household refrigeration appliances, are also used in other refrigeration systems such as, for example, ice cube-making machines. In such systems, the periodic defrost of an evaporator of the refrigeration system is carried out by the refrigerant fluid itself in the form of heated gas, which leaves the discharge of the compressor.

In a refrigeration system (of small or medium size), return of liquid refrigerant in the suction system is common due to incomplete vaporization of the liquid refrigerant. In this case, if a liquid separating device is not provided in the refrigeration circuit, the compressor may be damaged. The most common causes for liquid return are: excess refrigerant load in the refrigeration system; inadequate refrigeration of the evaporator; and incorrect adjustment of the expansion device. The phenomenon of liquid return is more intense in commercial compressors of high capacity and low-evaporation temperature.

Some compressors (see FIGS. 1 and 1A) present an open suction, that is, a suction-inlet tube 1, disposed through a wall of a shell 2, is opened to the interior of the latter. With this construction, the refrigerant fluid—in the form of gas—which reaches the suction-inlet tube 1, is admitted in the interior of the hermetic shell 2 of the compressor and is drawn from the internal environment of the shell 2 to the interior of a suction muffler 3 and, thence, to the interior of the compression chamber of the compressor.

In these known compressors, the suction-acoustic muffler 3 is provided in the interior of the hermetic shell 2, spaced from and above the suction-inlet tube 1. This suction arrangement allows the refrigerant fluid—in the form of gas—to be heated during its permanence in the interior of the shell 2, due to its contact with hot components of the compressor, before being drawn to the interior of the suction muffler 3 and, subsequently, to the interior of the compression chamber. The heating of the refrigerant fluid in the interior of the shell 2 presents the inconvenience of reducing the volumetric pumping capacity and, consequently, the energetic efficiency of the compressor. An example of this construction is presented in JP2008-267365, in which the flow admitted in the interior of the shell 2, through the outlet nozzle 1*a* of the suction-inlet tube 1, is deflected by the head, before reaching the inlet nozzle 4 of the admission tube 5 of the suction muffler 3, which is positioned spaced from the outlet nozzle 1*a* of the suction-inlet tube 1.

There are also known direct-suction compressors (see FIG. 1B), in which the refrigerant fluid, in the form of gas, returning to the compressor by the suction-inlet tube 1, is integrally directed to the interior of the suction muffler 3, without being admitted in the interior of the hermetic shell 2. In this type of suction arrangement, the refrigerant fluid is drawn to the compression chamber, through the suction-inlet tube 1 and through the suction muffler 3, without being subjected to the hot components of the compressor of the open-suction arrangement and, thus, yields a higher energetic efficiency of the compressor.

However, a direct-suction arrangement (FIG. 1B) can only be used in applications in which there is no risk of the refrigerant fluid—in the liquid state—being admitted in the compression chamber of the compressor. Nevertheless, in certain refrigeration systems—such as those used in ice cube-making machines a defrost operation for removing ice that accumulates in the evaporator region should be periodically carried out by the operation of the compressor. In this type of defrost operation, an inversion is made in the circuit of the refrigerant fluid in the refrigeration system, so that the refrigerant gas compressed and heated by the compressor is directed to an inlet of the evaporator and not to an inlet of the condenser, as it would during normal operation of a conventional refrigeration cycle.

During the defrost operation—in which the refrigeration system is submitted to cycle inversion—the refrigerant fluid is at least partially condensed in the evaporator, passes to the liquid phase, and is returned to the compressor. The refrigeration system remains operating in the inverted cycle during a certain period of time, until the desired degree of defrost has been obtained. Once the degree of defrost is obtained, the refrigeration system operates in the conventional manner with the refrigerant fluid in the gas phase and compressed by the compressor—being directed to the condenser inlet.

The refrigerant fluid in the liquid phase that leaves the evaporator and returns to the compressor during the defrost operation, has to be diverted from the normal-suction path to prevent it from being compressed by the compressor cylinder and causing a high inner pressure and consequent damages to the valves, gaskets and other parts of the compressor. Therefore, it is not possible to use a direct suction in these applications.

In order to prevent the liquid refrigerant fluid from entering into the suction chamber, some compressor constructions (particularly those for commercial application and which may be subjected to return of liquid during operation) present the suction muffler 3 provided with a refrigerant fluid inlet nozzle 4 spaced from the outlet nozzle 1*a* of the suction-inlet tube 1, which outlet nozzle 1*a* is opened to the interior of the compressor shell 2.

In the solution presented in JP2005-133707, the suction-acoustic muffler presents a refrigerant-fluid-admission tube provided spaced from the inner end of the suction-inlet tube. The admission tube presents a refrigerant-fluid-inlet nozzle substantially aligned with the inner end of the suction-inlet tube and conformed to incorporate a deflector defined for better admission of gaseous refrigerant fluid received through the suction-inlet tube. Nevertheless, during the suction, the spacing between the inner end of the suction-inlet tube and the inlet nozzle of the admission tube of the suction-acoustic muffler is not sufficient to prevent oil or refrigerant fluid in the liquid phase from being further drawn to the interior of the compressor, thereby damaging the latter.

In many hermetic compressor constructions (see FIG. 1) to be used in ice cube-making machines or in other applications in which there is the risk of liquid-refrigerant fluid returning to the compression chamber, the suction-inlet tube 1 is provided spaced from the refrigerant-gas inlet nozzle 4 in the suction muffler 3, generally opposed to each other in the interior of the shell 2, according to the open suction arrangement. In this type of mounting arrangement although eliminating the risk of liquid-refrigerant fluid returning to the interior of the compression chamber the loss of energetic efficiency of the compressor is not avoided due to the heating of the refrigerant fluid, as the latter is admitted in the interior of the hermetic shell 2 before being drawn to the interior of the suction muffler 3 and, therefrom, to the interior of the compression chamber.

There are also known in the art some suction arrangements which aim at minimizing or suppressing the risk of liquid-refrigerant fluid (or even oil) returning to the suction muffler, without submitting the refrigerant fluid to an undesirable heating in the interior of the hermetic shell. Examples of these arrangements can be seen in patent JP2007-255245.

In the solution presented in JP2007-255245, the suction-inlet tube comprises an extension internal to the compressor shell and formed by a lower portion that is leveled with the suction-inlet tube for a temporary accumulation of the liquid-refrigerant fluid which by chance exists in the suction flow and by an upper portion that is elevated in relation to the suction-inlet tube to conduct only the gaseous-refrigerant fluid and having an outlet nozzle axially spaced in relation to the inlet nozzle of the suction muffler. The nozzle incorporates a deflector defined for better admission of the gaseous-refrigerant fluid received through the suction-inlet tube. It should be noted that the provision of the deflector is desirable due to the fact that the inlet nozzle of the suction muffler has its axis coplanar to the axis of the outlet nozzle of the upper portion of the inner extension of the suction-inlet tube, but forming with the latter an approximately right dihedral angle by reasons of space and to prevent any liquid refrigerant which reaches the upper portion of the inner extension from being supplied to the suction muffler.

In this previous solution, there is a semi-direct suction, according to which the liquid-refrigerant fluid which by chance reaches the liquid accumulator is stored therein until reaching a determined volume capable of activating a valve element—such as an articulated cover which opens under pressure of the accumulated liquid—that allows the liquid to be discharged in the interior of the shell, without being directed to the compression chamber.

Although the previous solution commented above minimizes or even impairs the admission of liquid-refrigerant fluid in the compression chamber of the compressor, it is complex and onerous to be carried out, requiring changes to be made in the construction of the suction-inlet tube, generally in the form of an additional piece having two distinct outlets.

SUMMARY

As a function of the inconveniences commented above and also other disadvantages of the known constructive solutions, it is one of the objects of the present disclosure to provide a refrigeration compressor—of the type having a suction muffler mounted in the interior of a hermetic shell with a suction arrangement that minimizes or even impedes the admission of refrigerant fluid in a liquid phase into the compression chamber of the compressor, without submitting the refrigerant fluid in a gaseous phase being drawn by the compressor to an undesirable heating in the interior of the hermetic shell that could impair the energetic efficiency of the compressor in its normal refrigeration operation.

Another object of the present disclosure is to provide a suction arrangement that presents a reduced cost and does not require providing additional pieces in the interior of the compressor.

The suction arrangement of the present disclosure may be applied to a refrigeration compressor of the type that includes a hermetic shell carrying a suction-inlet tube that is provided with an outlet nozzle opened to the interior of the shell and through which a refrigerant-fluid flow containing at least one of the gaseous and liquid phases is expelled to the interior of the shell; a cylinder block mounted in the interior of the shell and defining a compression chamber with an end closed by a valve plate; a suction muffler mounted to the cylinder block and externally incorporating: an admission tube provided with an inlet nozzle turned to the suction-inlet tube; and an outlet tube for the refrigerant fluid, having an end nozzle maintained in communication with the compression chamber, through the valve plate.

In the arrangement of the present disclosure, the inlet nozzle of the admission tube may be provided adjacent and external to the axial projection of the contour of the outlet nozzle of the suction-inlet tube and turned to a shell region disposed between the outlet nozzle and the inlet nozzle. The inlet nozzle may admit under at least one of the conditions of underpressure in its interior or deflection of the flow in the interior of the shell the gaseous phase, if existing in the refrigerant-fluid flow, whereas the liquid phase, if existing in the refrigerant-fluid flow, is directed to a shell region external to the inlet nozzle.

In a particular aspect of the present disclosure, the inlet nozzle of the admission tube is positioned externally to the axial projection of the contour of the outlet nozzle of the suction-inlet tube and turned according to a direction orthogonal to the axis of the axial projection to a region of the latter provided in front of the inlet nozzle.

In another aspect of the present disclosure, the inlet nozzle of the admission tube is turned to a direction inclined in relation to the axis of the axial projection of the contour of the outlet nozzle of the suction-inlet tube and to an inner region of the shell, defined between the outlet nozzle and the inlet nozzle and in which the refrigerant-fluid flow is admitted.

Still in another aspect of the present disclosure, the inlet nozzle of the admission tube is turned according to a direction parallel to the axis of the axial projection of the contour of the outlet nozzle of the suction-inlet tube.

Still according to another aspect of the present disclosure, the suction arrangement includes a deflecting means provided in the interior of the shell, adjacent to the inlet nozzle of the admission tube, facing the outlet nozzle of the suction-inlet tube and configured to interfere with the refrigerant-fluid flow. The deflection means deflecting the liquid phase if existing in the refrigerant-fluid flow to the interior of the shell and its gaseous phase, if existing, to the inlet nozzle of the admission tube. In a particular aspect, the deflecting means is carried by one of the parts of shell, cylinder block and suction muffler. According to another particular aspect of the present disclosure, the deflecting means may be defined by at least one of the parts of cylinder block and a deflecting flange carried by any of the parts of cylinder block and shell. In a particular constructive variation, the deflecting means may be defined by a deflecting flange projecting arcuately outwardly from the admission tube, in the region of its inlet nozzle, adjacent to and facing the outlet nozzle of the suction-inlet tube and configured to receive, from the latter, the refrigerant-fluid flow, directing its gaseous phase, if existing, in a non-descending curved path, into the inlet nozzle of the admission tube, and directing, gravitationally, any liquid phase, if existing, outwardly from the admission tube and to the interior of the shell.

DRAWINGS

The drawings described herein are for illustrative purposes only of selected embodiments and not all possible implementations, and are not intended to limit the scope of the present disclosure.

DETAILED DESCRIPTION

Figure 1:
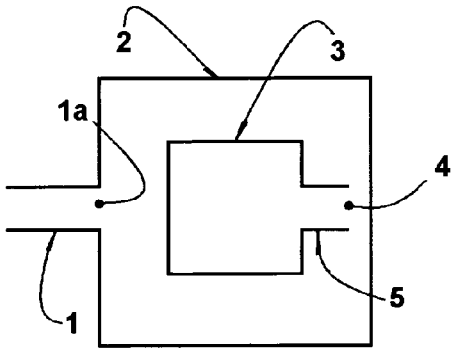
FIG. 1 PRIOR ART
FIG. 1 is a schematic representation of a compressor incorporating a prior-art suction muffler.
Figure 1A:
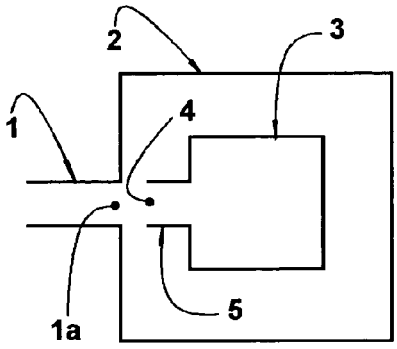
FIG. 1A PRIOR ART
FIG. 1A is a schematic representation of a compressor incorporating a prior-art suction muffler.
Figure 1B:
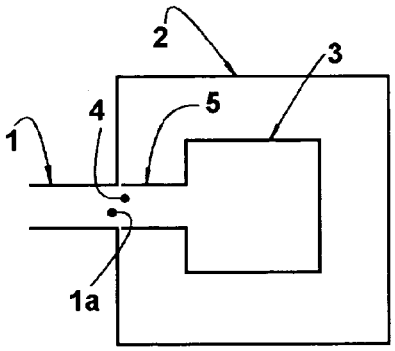
FIG. 1B PRIOR ART
FIG. 1B is a schematic representation of a compressor incorporating a prior-art suction muffler.
Figure 1C:
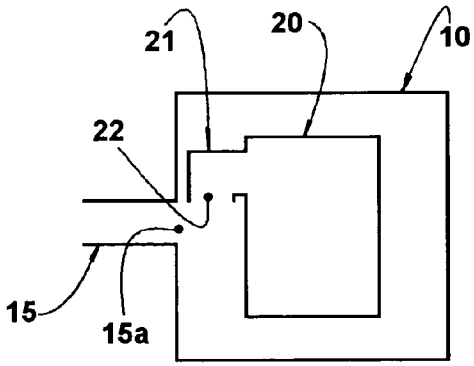
FIG. 1C is a schematic representation of a compressor incorporating a suction-acoustic muffler in accordance with the principles of the present disclosure.

As illustrated in the enclosed FIGS. 1C to 4A, the present disclosure provides a suction arrangement for a refrigeration-system compressor of the type including a hermetic shell 10; a cylinder block 11 mounted internally to the shell 10 and defining a compression chamber CC housing a reciprocating piston 12 and having an end closed by a valve plate 13 and by a head 14; and a suction muffler 20 mounted to the cylinder block 11 and externally incorporating: an admission tube 21 provided with an inlet nozzle 22; and an outlet tube 23 for the refrigerant fluid, having an end nozzle 24 maintained in communication with the compression chamber CC through the valve plate 13. In the illustrated construction, the outlet tube 23 is mounted in the head 14, attached to the cylinder block 2 through the valve plate 13 and in which at least one discharge chamber (not illustrated) is defined.

The shell 10 carries a suction-inlet tube 15 provided with an outlet nozzle 15*a* opened to the interior of the shell 10 and through which it is admitted, in the interior of the shell 10, a refrigerant-fluid flow which can contain—depending on the operational condition of the refrigeration system—only a gas phase, only a liquid phase, or both liquid and gas phases.

In the illustrated construction, the outlet nozzle 15*a* is defined as an opening in the shell 10 of the compressor, although the suction-inlet tube 15 could be provided extending through the interior of the shell 1. The suction-inlet tube 15 is generally mounted to a circuit of a refrigeration system (not illustrated) and which includes the compressor.

The suction muffler 20 may include a generally two-piece hollow body provided with the admission tube 21 and outlet tube 23.

In some compressor constructions, the body of the suction muffler 20 may be disposed inferiorly to the outlet nozzle 15*a* of the suction-inlet tube 15. In this case, the refrigerant fluid admitted in the suction muffler 20 is initially downwardly directed to the interior of the hollow body of the suction muffler 20, before being conducted to the outlet tube 23 and, thence, to the compression chamber CC.

It should be understood that the present disclosure is not restricted to a construction of suction muffler 20 of the type illustrated herein. The disclosure can also be applied to suction mufflers admitting refrigerant fluid parallelly to the axis of the outlet nozzle 15*a* of the suction-inlet tube 15 or above the latter.

According to the suction arrangement of the present disclosure, the inlet nozzle 22 of the admission tube 21 is provided adjacent but external to the axial projection of the contour of the outlet nozzle 15*a* of the suction-inlet tube 15 and turned to a region of the shell 10 that is disposed between the outlet nozzle 15*a* and the inlet nozzle 22. The inlet nozzle 22 may admit—under at least one of the conditions of underpressure in its interior or deflection of the flow in the interior of the shell 10 the gaseous phase of the flow.

According to the present disclosure, the inlet nozzle 22 of the admission tube 21 may be positioned somewhat spaced from the outlet nozzle 15*a* of the suction-inlet tube 15, so as to make the refrigerant-fluid flow travel a certain extension of the inner space of the shell 10 and to allow the gaseous phase of the flow to be deflected to the interior of the inlet nozzle 22 of the admission tube 21, by one or both means defined by the underpressure condition in the inlet nozzle 22 of the admission tube 21 and by a deflector 25 positioned in the interior of the shell 10 and which can be carried, for example, by the cylinder block 11. When the directioning of the gaseous phase to the interior of the inlet nozzle 22 is affected only by the underpressure reigning in the interior of the latter, the flow of gaseous phase admitted in the interior of the shell 10 through the outlet nozzle 15*a* of the suction-inlet tube 15 is deviated from its path upon leaving the outlet nozzle 15*a* by the suction imparted thereto by the inlet nozzle 22 of the admission tube 21.

Figure 2:
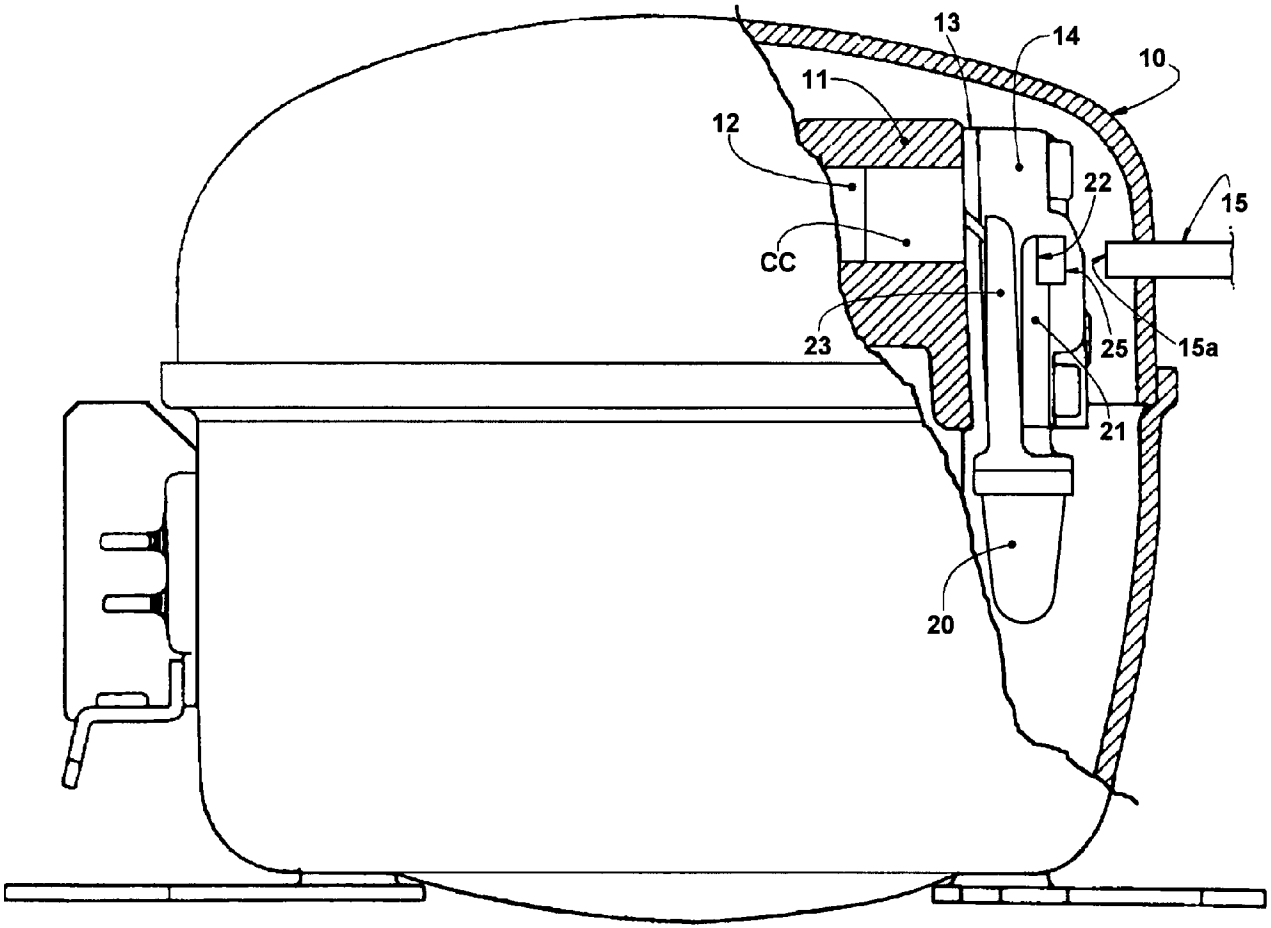
FIG. 2 is a partial sectional view of a compressor incorporating a suction muffler in accordance with the principles of the present disclosure.
Figure 2C:
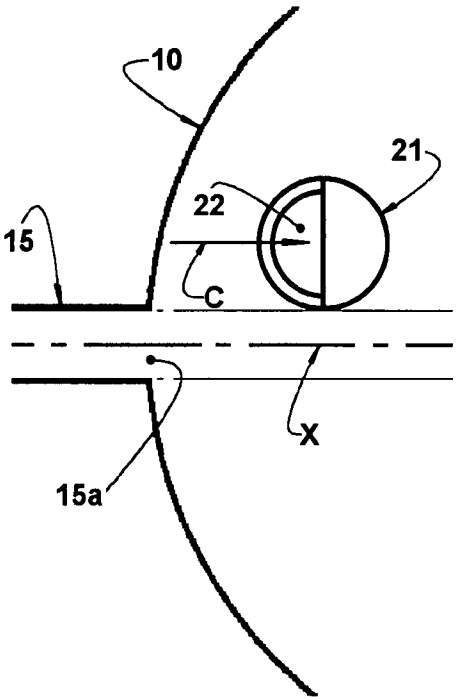
FIG. 2C is a schematic representation of an inlet nozzle of the suction muffler of FIG. 2 in a third position relative to the flow inlet of the compressor of FIG. 2.
Figure 2B:
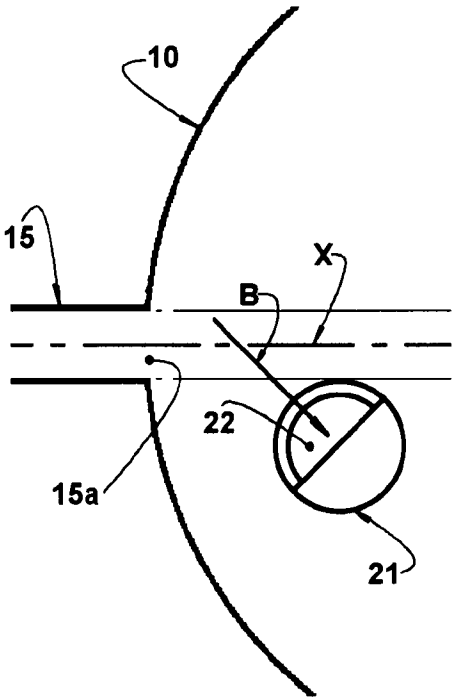
FIG. 2B is a schematic representation of an inlet nozzle of the suction muffler of FIG. 2 in a second position relative to the suction inlet of the compressor of FIG. 2.
Figure 2A:
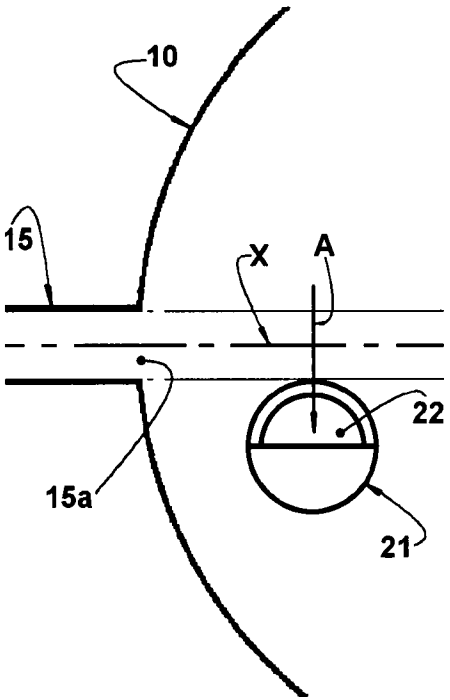
FIG. 2A is a schematic representation of an inlet nozzle of the suction muffler of FIG. 2 in a first position relative to an inlet of the compressor of FIG. 2.

According to a first construction for the suction arrangement of the present disclosure illustrated in FIG. 2A the inlet nozzle 22 of the admission tube 21 is mounted in the interior of the shell 10, turned according to a direction A substantially horizontal and orthogonal to the axis X of the axial projection of the contour of the outlet nozzle 15*a* of the suction-inlet tube 15, that is, turned to a region of the axial projection of the contour of the outlet nozzle 15*a* of the suction-inlet tube 15 that is provided in front of the inlet nozzle 22 of the admission tube 21.

In a particular aspect of this construction for the suction arrangement of the present disclosure, the inlet nozzle 22 of the admission tube 21 has a contour substantially tangent to the contour of the refrigerant-fluid flow.

The advantage of the first construction of the arrangement of the present disclosure is that, by positioning the admission tube 21 at a certain distance from the outlet nozzle 15*a* as shown in FIG. 2A it is possible to initially obtain a considerable reduction around 80% of the suction of the liquid phase of the refrigerant-fluid flow to the interior of the inlet nozzle 22 of the admission tube 21. This position allows the gaseous phase of the refrigerant-fluid flow to enter into the inlet nozzle 22 of the admission tube 21, by means of a semi-direct suction. In this mounting condition, the gaseous phase of the refrigerant fluid is deviated to the interior of the inlet nozzle 22 of the admission tube 21 by means of the underpressure reigning in the interior of the latter and/or with the aid of a deflector to be described ahead.

In high-efficiency commercial compressors, a deflector (FIG. 3) may be employed to direct the gaseous phase of the refrigerant-fluid flow to the inlet nozzle 22 of the admission tube 21, thus increasing the capacity of the compressor without the risk of admitting the liquid phase into the suction muffler 20. The deflector 25 may be defined by a compressor component internal to the shell 10, or by an additional component mounted in the region of the inlet nozzle 22 to deviate the gaseous phase of the refrigerant-fluid flow to the interior of the inlet nozzle 22, but without allowing the liquid phase to be admitted into the suction muffler 20. The deflector 25 may be capable of directing the liquid phase of the refrigerant-fluid flow to an internal region of the shell 10 external to the inlet nozzle 22 of the admission tube 21.

According to a second construction for the suction arrangement of the present disclosure illustrated in FIG. 2B the inlet nozzle 22 of the admission tube 21 is turned according to a direction B inclined in relation to the axis X of the axial projection of the contour of the outlet nozzle 15*a* of the suction-inlet tube 15 and to an inner region of the shell 10, for admitting the refrigerant-fluid flow and which is defined between the outlet nozzle 15*a* and the inlet nozzle 22.

In a first particular construction of this second suction arrangement of the present disclosure, the inlet nozzle 22 of the admission tube 21 has its contour substantially tangent to the axial projection of the contour of the outlet nozzle 15*a* of the suction-inlet tube 15, as illustrated in FIG. 2B.

Although not specifically illustrated in the drawings herein, it should be understood that the inlet nozzle 22 of the admission tube 21 may have its contour substantially tangent to the contour of the refrigerant-fluid flow, in situations in which this contour extrapolates, radially, the limits of the contour of the axial projection of the outlet nozzle 15*a* of the suction-inlet tube 15.

The second construction commented above has the advantage of increasing the mass of the gaseous phase of the refrigerant-fluid flow drawn by the inlet nozzle 22 of the admission tube 21, consequently increasing the efficiency of the compressor.

On the other hand, positioning of the inlet nozzle 22 in relation to the refrigerant-fluid flow admitted in the shell 10 requires a larger spacing of the inlet nozzle 22 in relation to the contour of the refrigerant-fluid flow, in order to reduce the risk of admitting the liquid phase in the interior of the inlet nozzle 22 of the admission tube 21. However, the reduction of the risk leads to loss of efficiency in admitting the gaseous phase of the refrigerant-fluid flow that is being released through the suction-inlet tube 15 to the interior of the shell 10.

In order to minimize the risks of admitting the liquid phase in the suction muffler 20 without reducing the efficiency in admitting the gaseous phase a deflector 25 may be employed, as already described in relation to the first construction for the mounting arrangement (FIG. 2A).

According to a third construction for the suction arrangement of the present disclosure—illustrated in FIG. 2C—the inlet nozzle 22 of the admission tube 21 is turned according to a direction C substantially parallel to the axis X of the axial projection of the contour of the outlet nozzle 15*a* of the suction-inlet tube 15.

In a first particular way of carrying out the third construction of the present disclosure (FIG. 2C), the inlet nozzle 22 of the admission tube 21 has its contour substantially tangent to the axial projection of the contour of the outlet nozzle 15*a* of the suction-inlet tube 15.

Although not being specifically illustrated in the drawings, it should be understood that, for the third construction of the suction arrangement of the present disclosure, the inlet nozzle 22 of the admission tube 21 may have its contour substantially tangent to the contour of the refrigerant-fluid flow in situations in which this contour radially extrapolates the limits of the contour of the axial projection of the outlet nozzle 15*a* of the suction-inlet tube 15.

The third constructive arrangement may be used when there is insufficient space in the interior of the shell 10 from the constructions shown in FIGS. 2A and 2B and/or when there is no possibility of using other component parts as a deflector.

For low-capacity compressors, the third solution is adequate and sufficient to avoid the suction of the liquid phase of the refrigerant-fluid flow through the inlet nozzle 22 of the admission tube 21. However, in high-capacity compressors, efficiency can be impaired. It should be understood that because the refrigerant-fluid flow can present a certain dispersion after passing through the outlet nozzle 15*a* until reaching the inlet nozzle 22 of the admission tube 21, a tangential condition of the inlet nozzle 22 in relation to the contour of the axial projection can result in determined distances between the inlet nozzle 22 of the admission tube 21 and the outlet nozzle 15*a* of the suction-inlet tube 15, in a secant condition of the inlet nozzle 22 in relation to the contour of the refrigerant-fluid flow.

It should be understood that, in the constructive options commented above and exemplarily illustrated in FIGS. 2A, 2B and 2C, the inlet nozzle 22 of the admission tube 21 may be arranged in different positions around the axial projection of the contour of the outlet nozzle 15*a* of the suction-inlet tube 15. The position of the inlet nozzle 22 of the admission tube 21 (distance, laterality)—in relation to the outlet nozzle 15*a* of the suction-inlet tube 15 may be defined as a function of the inner space in the shell 10 of the compressor that is available for mounting the suction muffler 20, the design characteristics of the compressor, and the refrigeration system to which it is coupled.

The present solution may further provide a misalignment between the inlet nozzle 22 of the admission tube 21 and the outlet nozzle 15*a* of the suction-inlet tube 15, so that at least a substantial part of the liquid phase of the refrigerant-fluid flow passes through the region of the inlet nozzle 22 of the admission tube 21, without being admitted therein in an amount that can be harmful to the operation of the compressor.

In one of the ways of carrying out the present disclosure, the gaseous phase of the refrigerant-fluid flow may be directed to the interior of the suction muffler 20 due to the depression caused by the difference of pressure between the interior of the shell 10 and the interior of the suction muffler 20 during the suction cycle of the compressor, as the inner pressure of the suction muffler 20 is lower than in the interior of the shell 10, due to the suction cycles during operation of the compressor. With pressure reduction, the suction muffler promotes suction of the gaseous phase of the refrigerant-fluid flow. The low pressure that draws the gas from the refrigerant-fluid flow is not sufficient—together with the positioning of the inlet nozzle 22 of the admission tube 21 to draw the liquid phase of the refrigerant-fluid flow which is at a high velocity when entering into the interior of the shell 10 from the outlet nozzle 15*a* of the suction-inlet tube 15. The underpressure in the interior of the suction muffler 20 acts as a non-physical deflecting means for the gaseous phase of the refrigerant-fluid flow. In this case, the liquid phase of the refrigerant-fluid flow is directed, for example, gravitationally and/or inertially, to the interior of the shell 10, as its velocity decreases. A deflector is not necessarily provided to act on the flow to modify the path of its liquid phase in order to prevent it from being admitted in the inlet nozzle 22 of the admission tube 21 in any amount that can be harmful to the compressor.

In a way of carrying out this aspect of the present disclosure, the inlet nozzle 22 of the admission tube 21 may be positioned at a determined distance from the outlet nozzle 15*a* of the suction-inlet tube 15, so that the liquid phase of the refrigerant-fluid flow has its path modified by the loss of velocity of this refrigerant-fluid flow.

According to another particular aspect of the present disclosure, the liquid phase of the refrigerant-fluid flow has its path interrupted in the internal environment of the shell 10, by a deflector 25 provided in the interior of the shell 1. The deflector 25 may be positioned adjacent to the inlet nozzle 22 of the admission tube 21, facing the outlet nozzle 15*a* of the suction-inlet tube 15 and configured to receive, from the latter, the refrigerant-fluid flow, interfering with the path of the liquid phase of the refrigerant fluid and gravitationally directing any liquid phase, if existing, to the interior of the shell 10. The deflector 25 may be used when it is not possible to use only the underpressure and the relative positioning between the inlet nozzle 22 of the admission tube 21 and the outlet nozzle 15*a* of the suction-inlet tube 15 as a separating element between the gaseous and liquid phases of the refrigerant-fluid flow.

The deflector 25 may be carried by one of the parts of shell 10, cylinder block 11 and suction muffler 20 and may be defined, for example, by an element of the suction muffler 20 or of the compressor. In particular, the deflector 25 may be defined as an adjacent and confronting inner wall portion of the shell 10.

In a way of carrying out the present disclosure, the deflector 25 may be defined by the cylinder block 11 of the compressor, such as the head 14 generally seated against the valve plate 13 and which defines at least one of the suction and discharge chambers of the compressor (not illustrated), in fluid communication with the compression chamber CC in the cylinder block 11.

The deflector 25 may be positioned close to the inlet of the suction muffler 20, adjacent thereto and relative to the inlet nozzle 22 of the admission tube 21 so that the liquid phase of the refrigerant-fluid flow is received by the deflector 25 and inertially and/or gravitationally directed to the interior of the shell 10.

The deflector 25 may be defined by at least one of the parts of cylinder block 11 and by a deflecting flange carried by any of the parts of cylinder block 11 and shell 10, or also by a deflecting flange 25*a* (FIGS. 3 and 3A), projecting arcuately outwardly from the admission tube 22 in the region of its inlet nozzle 22, adjacent to and facing the outlet nozzle 15*a* of the suction-inlet tube 15. The deflector 25 is configured to receive, from the outlet nozzle 15*a* of the suction-inlet tube 15, the refrigerant-fluid flow, directing its gaseous phase, in a non-descending curved path, into the inlet nozzle 22 of the admission tube 21 and gravitationally and/or inertially directing any liquid phase, if existent, outwardly from the admission tube 21 and to the interior of the shell 10.

Figure 3:
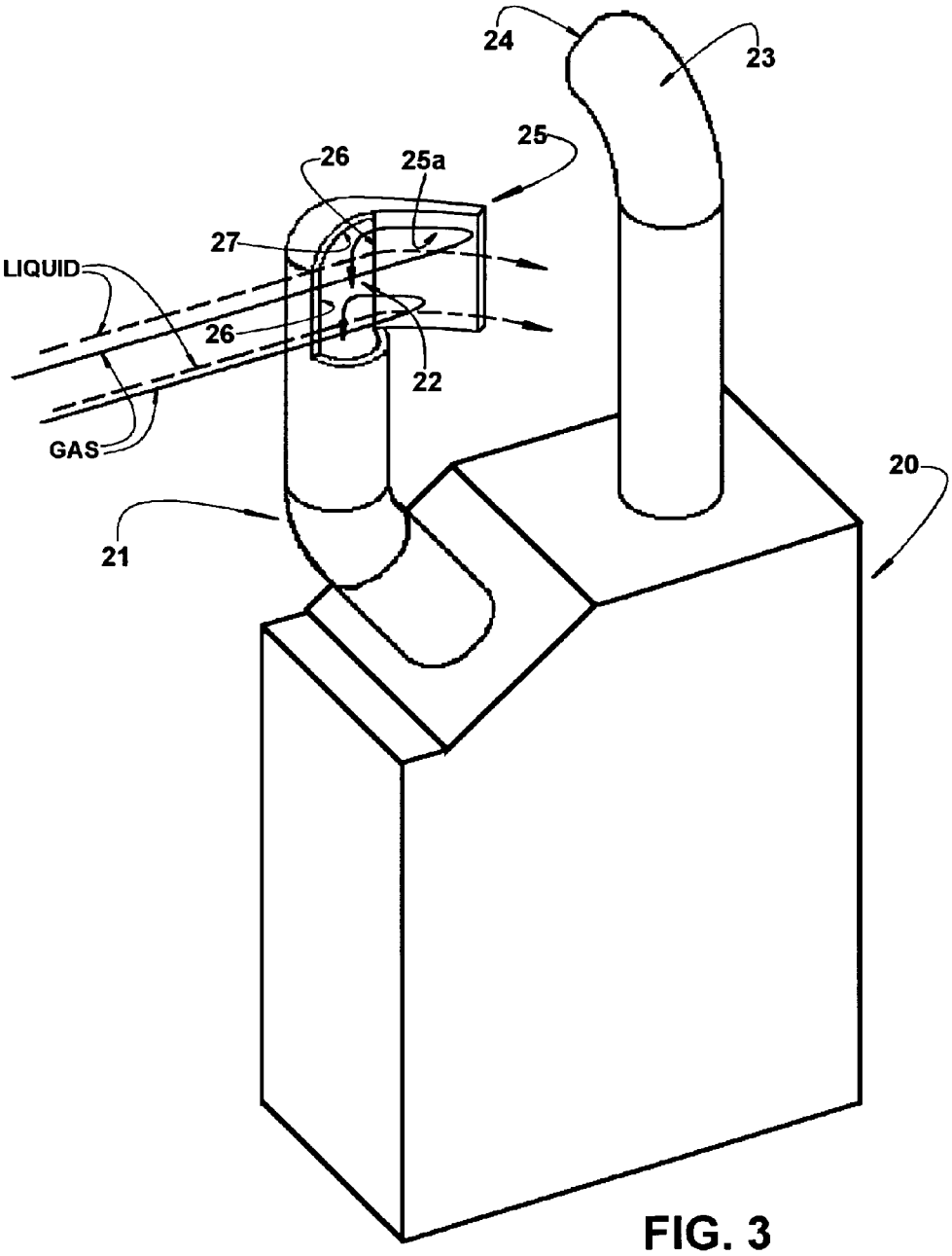
FIG. 3 is a perspective view of a suction muffler according to the principles of the present disclosure.
Figure 3A:
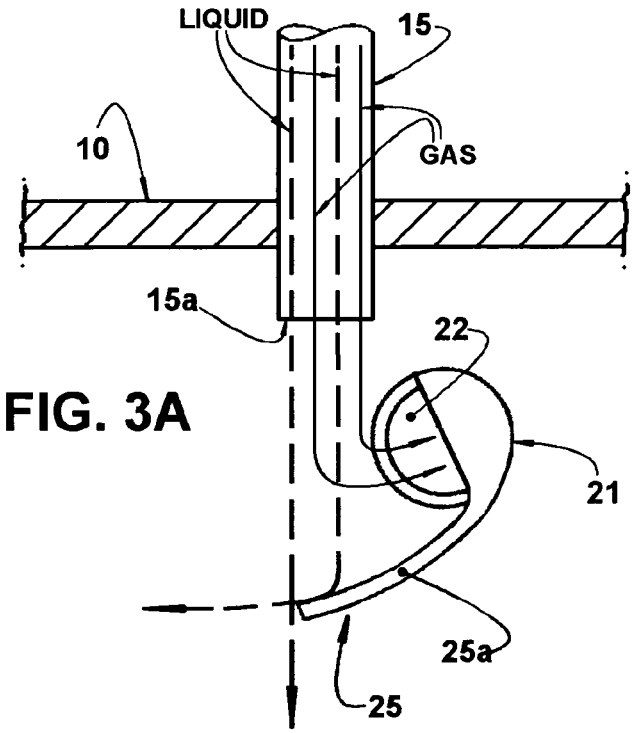
FIG. 3A is a partial perspective view of the suction muffler of FIG. 3 incorporated into a compressor and showing a position of an inlet of the suction muffler relative to an inlet of the compressor.
Figure 4A:
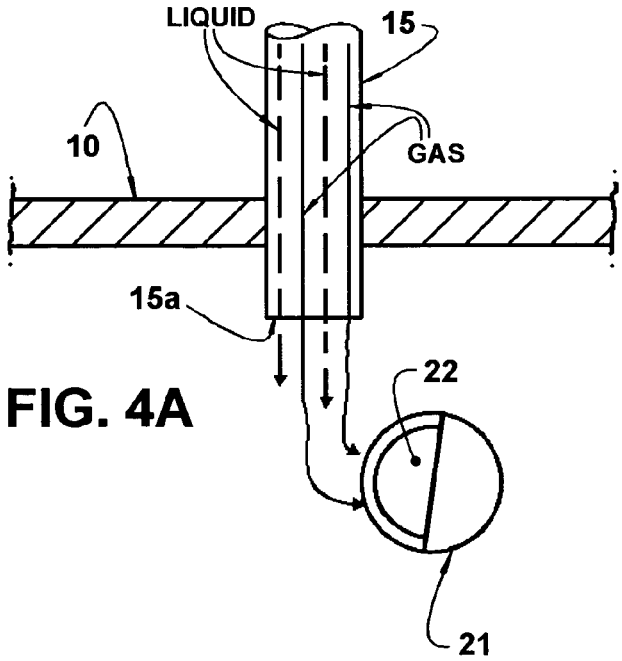
FIG. 4A is a partial perspective view of the suction muffler of FIG. 4 incorporated into a compressor and showing a position of an inlet of the suction muffler relative to an inlet of the compressor.
Figure 4:
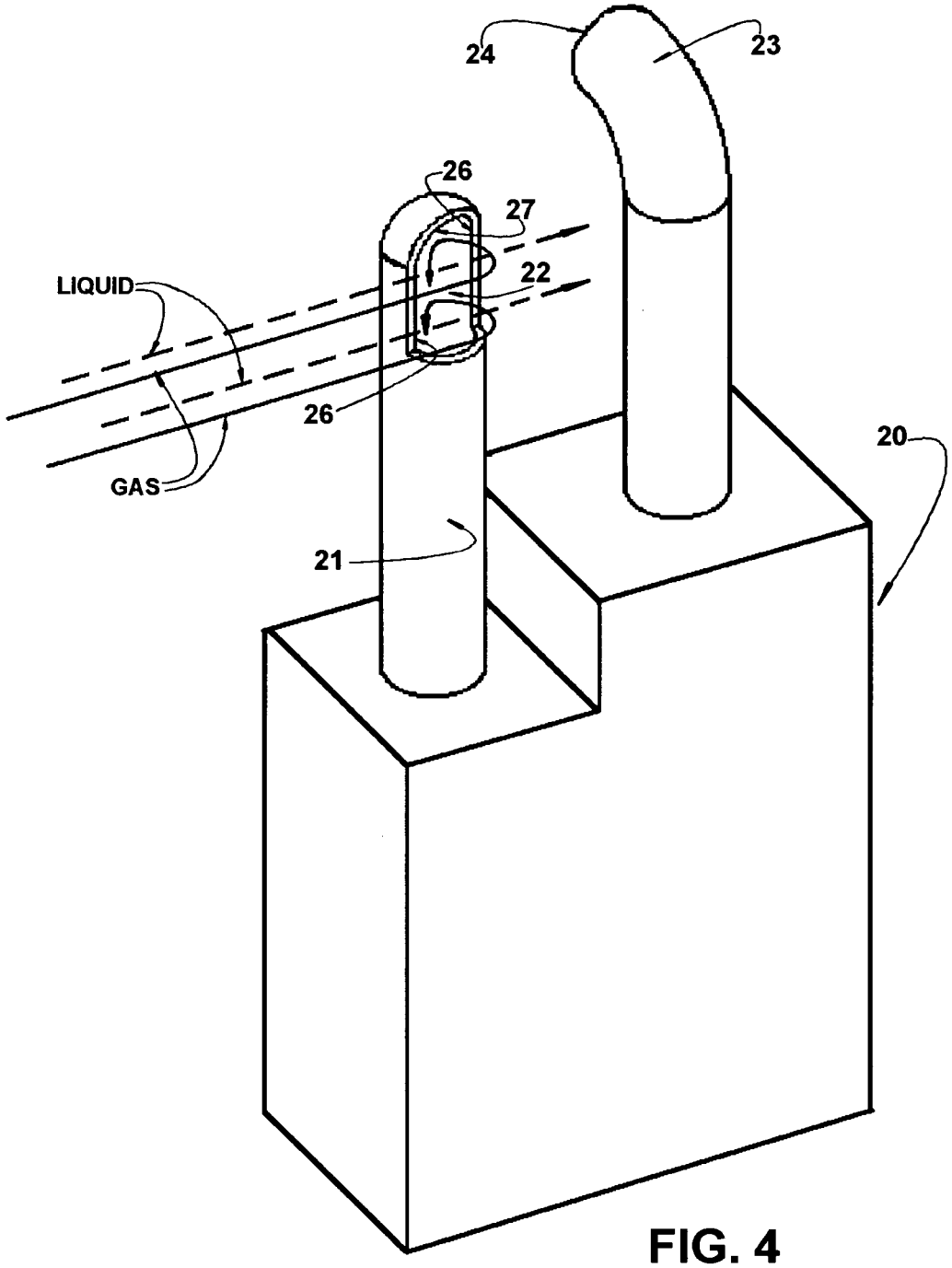
FIG. 4 is a perspective view of a suction muffler according to the principles of the present disclosure.

FIGS. 3 and 3A show, schematically, the refrigerant fluid flow impinging a deflecting flange 25*a*, which is positioned in order to allow the gaseous phase (plain arrows) of the refrigerant fluid flow to be suctioned into the inlet nozzle 22, while blocking and deflecting the path of the any liquid phase (dotted arrows), allowing it to be gravitationally and or inertially directed into the shell 10.

The deflecting flange 25*a* of the present disclosure receives, directly, the refrigerant-fluid flow admitted in the interior of the shell 10 through the outlet nozzle 15*a* of the suction-inlet tube 15, actuating as a baffle for the refrigerant fluid in the liquid phase, which, after reaching the deflecting flange 25*a*, gravitationally and/or inertially flows from the latter, precipitating to the interior of the shell 10 towards the bottom thereof.

According to a way of carrying out the disclosure, as illustrated in the appended drawings, the inlet nozzle 22 of the admission tube 21 presents a pair of side edges 26 and an upper edge 27 that are contained in a plane substantially parallel to the axis of the admission tube 11 and secant to the contour of the latter, in order to provide, to the inlet nozzle 22, a cross section with an area at least equal to the cross sectional area of the outlet nozzle 15*a* of the suction-inlet tube 15.

The illustrated inlet nozzle 22 of the admission tube 21 presents a pair of side edges 26 and an upper edge 27 that are contained in a plane substantially parallel to the axis X of the outlet nozzle 15*a* of the suction-inlet tube 15. The plane maintains, with the axis of the admission tube 21, a constant distance defined so as to provide, to the inlet nozzle 22 of the admission tube 21, a cross section with an area at least equal to the cross sectional area of the outlet nozzle 15*a* of the suction-inlet tube 15.

The deflecting flange 25*a* may be incorporated, in a single piece, to a side edge of the pair of side edges 26 of the inlet nozzle 22 of the admission tube 21, occupying, for example, the whole extension thereof. The deflecting flange 25*a* may be rectilinear and coplanar to a plane containing the opposite side edges 26 of the inlet nozzle 22 of the admission tube 21, and can be slightly inclined to the plane, so as to facilitate the down-flow of the liquid reaching the face of the deflecting flange 25*a* turned to the suction-inlet tube 15 and which receives the refrigerant-fluid flow admitted by the suction-inlet tube 15.

According to a preferred form of the present disclosure, the curved path imparted to the gaseous phase of the refrigerant-fluid flow during its admission through the inlet nozzle 22 of the admission tube 21, presents only one direction. In the illustrated construction, the refrigerant fluid, in the gaseous phase, is submitted to a substantially horizontal curved path between the outlet nozzle 15*a* of the suction-inlet tube 15 and the inlet nozzle 22 of the admission tube 21, and then the refrigerant fluid, in gaseous phase, is forced, by the suction, to change the direction of its path, which becomes orthogonal to the direction of admission in the inlet nozzle 22 of the admission tube 21, and which, in the illustrated construction, is vertical and downwardly inclined.

However, it should be understood that other solutions are possible within the concept presented herein, in which the positioning of the inlet nozzle 22 or even of the admission tube 21 in relation to the outlet nozzle 15*a* of the suction-inlet tube 15 can provoke a path for the refrigerant fluid—in its gaseous phase—with more than one change of direction, in the same plane of admission of the refrigerant-fluid flow being admitted by the suction-inlet tube 15, or defining a helical path for this refrigerant-fluid flow.

According to the present disclosure, the deflecting flange 25*a* presents a dimension in the axial direction of the admission tube 21 at least equal to the dimension, in the same direction, of the inlet nozzle 22 of the admission tube 21 and of the cross section of the outlet nozzle 15*a* of the suction-inlet tube 15. According to a particular aspect of the present disclosure, the deflecting flange 25*a* projects radially outwardly from the contour of the admission tube 21, defining a volute portion.

According to the illustration in FIG. 3, the admission tube 21 may present, in a way of carrying out the present disclosure, a first portion, which is adjacent to the inlet nozzle 22 and substantially parallel to the outlet tube 23, and a second portion, inferiorly positioned in relation to the first portion and which extends to the hollow body of the suction muffler 20, being angularly positioned in relation to the first portion. In one configuration, the position is calculated to define a desired spacing between the inlet nozzle 22 of the admission tube 21 and the outlet nozzle 15*a* of the suction-inlet tube 15.

Although not illustrated, the deflecting flange 25*a* may be dimensioned so that the volute defines a larger or smaller path extension for the gas being admitted, maintaining its function of blocking and deflecting the liquid phase of the refrigerant fluid.

In the preceding configurations, a predetermined distance may be maintained between the outlet nozzle 15*a* of the suction-inlet tube 15 and the inlet nozzle 22 of the admission tube 21, originating a semi-direct suction that provides high efficiency to the compressor. The use of a deflector optimizes the efficiency of the arrangement because it better directs the liquid phase of the refrigerant fluid beyond the reach of the inlet nozzle 22 of the admission tube 21 of the suction muffler 20. The deflector can be the head 11 or in other parts of the compressor that are adjacent to the outlet nozzle 15*a* of the suction-inlet tube 15.

The invention claimed is:

1. A suction arrangement for a refrigeration compressor of the type which comprises:

a hermetic shell carrying a suction-inlet tube extending along a first axis, the suction-inlet tube provided with an outlet nozzle opened to the interior of the shell and through which a refrigerant-fluid flow, containing at least one of gaseous and liquid phases, is expelled to the interior of the shell along the first axis;

a cylinder block mounted in the interior of the shell and defining a compression chamber with an end closed by a valve plate and by a head;

a suction muffler mounted to the cylinder block and externally incorporating: an admission tube extending along a second axis wherein the second axis does not intersect with the first axis, the admission tube provided with an inlet nozzle disposed at a distal end of the admission tube, the inlet nozzle turned to the suction-inlet tube; and an outlet tube in communication with the compression chamber, the arrangement being characterized in that the inlet nozzle of the admission tube is provided adjacent to and is laterally displaced from the first axis and is turned to face a direction which is orthogonal to both the first and second axes, the inlet nozzle admitting, under an underpressure in its interior, the gaseous phase, if existing in the refrigerant-fluid flow, whereas the liquid phase, if existing in the refrigerant-fluid flow, is directed to a region of the shell external to the inlet nozzle.

2. The suction arrangement, as set forth in claim 1, characterized in that the inlet nozzle of the admission tube has a contour tangent to the contour of the refrigerant fluid flow.

* * * * *